United States Patent [19]

Taylor

[11] 4,418,635

[45] Dec. 6, 1983

[54] SINGLE-FLUKE ANCHOR

[76] Inventor: James M. Taylor, Box 4216, West Palm Beach, Fla. 33402

[21] Appl. No.: 280,484

[22] Filed: Jul. 6, 1981

Related U.S. Application Data

[63] Continuation-in-part of Ser. No. 25,335, Mar. 30, 1979, abandoned.

[51] Int. Cl.[3] ..... B63B 21/40

[52] U.S. Cl. ..... 114/304

[58] Field of Search ..... 114/294, 301–310

[56] References Cited

U.S. PATENT DOCUMENTS

| | | | |
|---|---|---|---|
| 730,009 | 6/1903 | Duncanson | 114/294 |
| 2,202,856 | 6/1940 | Hottel | 114/305 |
| 2,487,549 | 11/1949 | Hess | 114/307 |
| 3,961,451 | 6/1976 | McCain | 114/304 |
| 4,154,187 | 5/1979 | Taylor | 114/304 |

FOREIGN PATENT DOCUMENTS

| | | | |
|---|---|---|---|
| 1100518 | 1/1968 | United Kingdom | 114/299 |

*Primary Examiner*—Sherman D. Basinger

*Attorney, Agent, or Firm*—Sherman & Shalloway

[57] ABSTRACT

An anchor in which an L-shaped shank has a single fluke pivotally secured to the shorter leg of the L. The L-shaped shank lies substantially in a plane. The fluke pivots through the plane but not in the plane. The fluke has a single triangular, planar fluke member which may be disposed in the plane. The longer leg of the shank is arcuate and the anchor cable is attached thereto.

30 Claims, 5 Drawing Figures

SINGLE-FLUKE ANCHOR

BACKGROUND OF THE INVENTION

This is a continuation-in-part application of application Ser. No. 25,335, filed Mar. 30, 1979, now abandoned.

The invention relates to anchors such as are commonly used for mooring ships, boats, and other types of marine craft.

Anchors have been used for centuries and generally comprise two essential elements: a shank and at least one fluke. The object of anchors is for the fluke to engage the solid of the bed of the body of water. The fluke is generally secured to one end of the shank. The other end of the shank is joined to a cable which, in turn, is tied to the craft. Beyond these essential common elements, anchor constructions vary widely. One reason for the variety of anchor designs if the various types of bed soil conditions that are encountered in moorings. Thus, soils may be sandy, contain rocks, be hard or soft, have plant growth, or any combination of the foregoing. No one previous anchor is believed to be able to engage all types of soil conditions satisfactorily.

While there have been a variety of different anchor types, their respective construction may be conveniently viewed with the fluke being either symmetrical or quasi-symmetrical about a principle plane defined by the shank. In "symmetrical" anchors, the fluke is either fixed or pivotally secured to the shank and the major surface or surfaces of the fluke palm remains disposed symmetrically with reference to the plane of symmetry of the shank.

An example of a symmetrical anchor is disclosed by John K. Northrop et al. in U.S. Pat. No. Re. 21,841. The plane of the palm of the fluke extends outwardly and symmetrically on either side of the shank. The fluke plane is thus perpendicular to a plane which is perpendicular to the shank plane and, at the same time at an acute angle to the shank plane. The purpose of this design is to provide, with the cable end of the shank against the bed, the fluke with an acute attack angle for digging in. The disadvantage with this design is that soil is seldom uniform in consistency and compliance. It is believed that in hard soils, the fluke proposed by John K. Northrop et al. will scrape the bottom. In uneven soils, containing rocks or the like, the forces exerted upon the fluke as the anchor is pulled by the cable will be uneven causing the fluke to up end and turn out. This tendency to turn out of engagement appears to be common to most symmetrical anchors.

Still another anchor is disclosed by Danforth in U.S. Pat. No. 2,674,969. Danforth proposed an anchor in which the fluke is symmetrical with the plane of the shank, as in anchor disclosed by John K. Northrop et al. In Danforth the shank is a rod-like member and the fluke is secured directly thereto and forms the acute angle directly with the shank. In the anchor proposed by Northrop et al., the fluke is secured to the shank by a so-called "fluke arm", which extends perpendicularly from the shank in the shank plane. However, the deficiencies of the Danforth designed anchor are essentially the same. In current commercialized versions of the Danforth anchor, the fluke is pivotally secured to the shank.

Still another version of a symmetrical anchor are so-called "wishbone" anchors. In such anchors, such as those by: Hillcourt, in U.S. Pat. No. 3,022,762; Pitzipio, in U.S. Pat. No. 2,696,187; Childs, in U.S. Pat. No. 2,733,678; and the inventor herein in a commercialized anchor sold under the trademark WISHBONE, a bifurcated shank defines the shank plane. The shank is joined at the cable end. The fluke is pivotally secured between the shanks at the opposed bifurcated end. The bifurcated shanks are believed to provide a "roll-bar" so that, as uneven soil forces tend to lift the anchor, the fluke is forced downwardly by one of the shanks. However, a major disadvantage to this type of anchor is that the area of the box-like wishbone frame acts to block the depth to which the fluke can engage the soil.

Quasi-symmetrical anchors are those in which a fluke is disposable symmetrically about a principal or symmetrical plane of the shank, but pivotally secured to assume asymmetrical positions with respect to the principal plane.

One example of such a quasi-symmetrical anchor is proposed by Taylor in U.S. Pat. No. 1,974,933. Taylor discloses a plow-shaped fluke which is disposed so that the blades of the plow are arranged symmetrically on each side of the shank plane of symmetry. However, the fluke is pivotally secured so that is moves on an angle which is aslant with that plane. Thus, the fluke is articulated so that it has a component of movement perpendicular to the shank plane and a component of movement in the shank plane. The axis of rotation extends from the shank and through the plow tip of the fluke. (This is to be distinguished from the pivotal movement of the wishbone-type anchors or the anchor proposed by Danforth. In these latter anchors, the fluke is disposed symmetrically with respect to the shank and moves perpendicularly with respect to a plane which is perpendicular to the shank plane.)

The device proposed by Taylor provides a number of disadvantages. Because the axis of rotation of the fluke is through the plow tip, these forces tend to push the fluke out of the soil independently of the position of the shank. In other words, as the plow is rotated downwardly, the rotation of the fluke meets little resistance from the shank to which it is attached and can spiral back upwardly in uneven soil conditions when pressure exerted on the fluke is greater on one side than on the other.

Another quasi-symmetrical anchor is proposed by Brewer, in U.S. Pat. No. 2,681,631. Brewer discloses a fluke in which the plane of the palm is perpendicular to the shank plane. The palm extends downwardly from the shank to assume as asymmetrical orientation with respect to the shank plane. Thus, the fluke is so secured so that the the palm moves perpendicularly to the plane of the shank. The disadvantage of the anchor proposed by Brewer is that the edge of the fluke rotates against the soil and thus moves into and out of the soil much as a wheel or disc engaging the soil. Thus, this anchor tends to pivot into and out of engagement with the bed.

Still another disadvantage of all prior art devices is believed to be the amount of "rode" necessary to secure an anchor. The rode is the cable length necessary to permit an anchor to moor the craft. Preferably, the "scope" or ratio of rode to depth is approximately 7:1. The reason for the "rode" requirement is believed to be the maintenance of the proper "attack" angle of the fluke. The attack angle may be defined as that acute angle formed between the bed and the fluke. In operation, the prior art anchors are dragged along the bed with the shank-shackle end abutting the bed and the fluke digging in with a large attack angle. As the fluke is dragged along the bed, it is intended to dig in, thereby reducing its attack angle until the shank is substantially flush with the bed. If the "rode" is too short, particularly where the bed has a declination, the shank will be lifted off the bed and will thereby decrease the attack angle of the fluke. When this happens, the initial entry angle of the fluke will be shallow. This is particularly true in symmetrical anchors, such as proposed by Danforth. The pivotal movement of the fluke merely allows the shank to ride upward at the fluke or rear end of the anchor as the shank is pulled at the shackle or front end. However, if the rode is too short, the shank will be lifted in any event with the consequent reduction of the initial attack angle.

SUMMARY OF THE INVENTION

It is an object of this invention to provide an anchor which is simple in use and economic to manufacture.

It is another object of this invention to provide an anchor which may be operative on shorter "rodes" than has heretofore believed to be possible.

It is an object of this invention to provide an anchor which will stow easily on a variety of bow roller and automatic stowing systems used by craft large and small and provide a compact design for ease of stowage in the characteristically confining conditions of boats.

It is still another object of this invention to provide an anchor which provides improved moorage to beds regardless of the type of soil and condition of the anchorage.

In furtherance of these objectives and others that will become more apparent in the following discussion, there is provided, in accordance with the teachings of this invention, an anchor having a shank lying within a plane. A fluke is pivotally secured to the shank so as to be pivotal about an axis within the shank, permitting the fluke to rotate to either side of the plane. The fluke and the shank move together within the plane. The principal plane of the fluke is disposable so as to be co-planar with the shank plane.

DESCRIPTION OF THE PREFERRED EMBODIMENTS

As previously indicated, one major disadvantage of all prior art anchors is the inability to provide secure moorings in beds of all types. Another disadvantage is the long "rode" required to moor crafts, thereby making inshore moorings and close quarters moorings difficult or impractical to achieve.

(Throughout, the terms "forward" and "rear" are used with reference to the general direction of movement of an anchor when being moved into operation by the pull of a cable. The term "bottom" or "bed", unless specifically qualified, refers to the ground beneath a body of water.)

Figure 1:
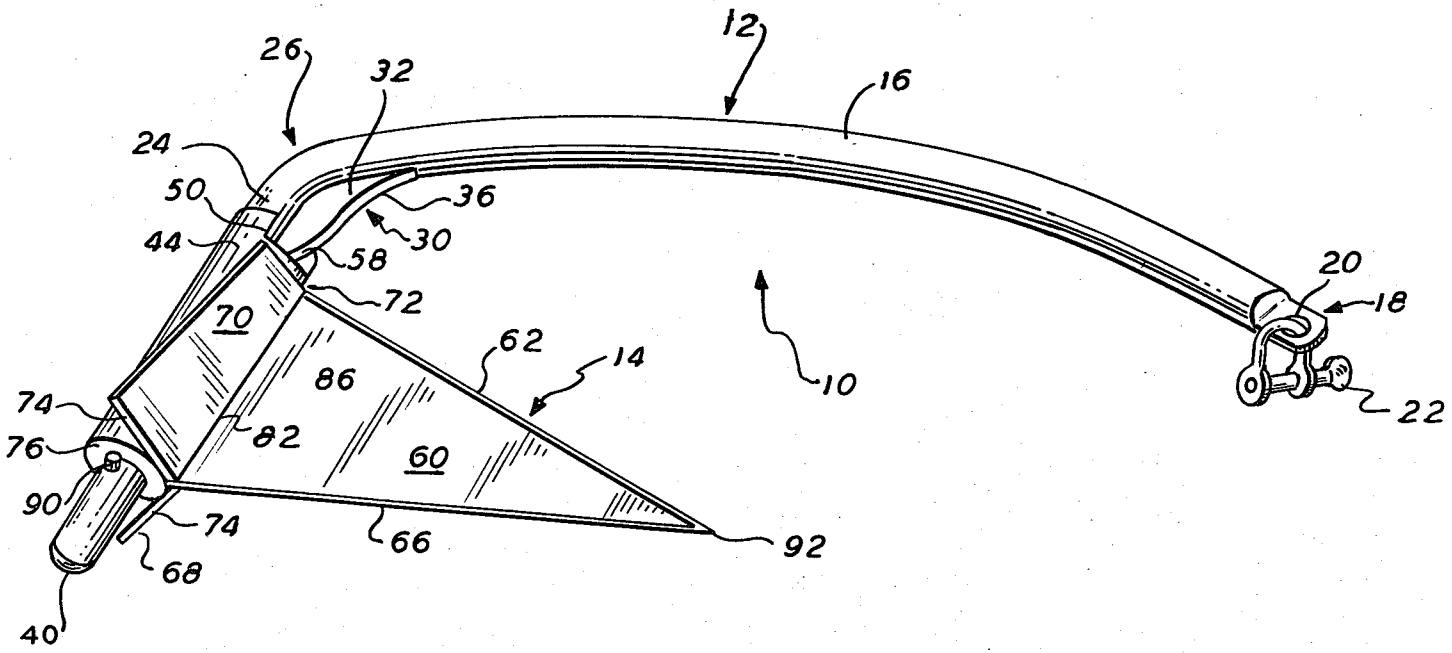
FIG. 1 is a perspective view of an anchor constructed in accordance with the teachings of this invention.
Figure 2:
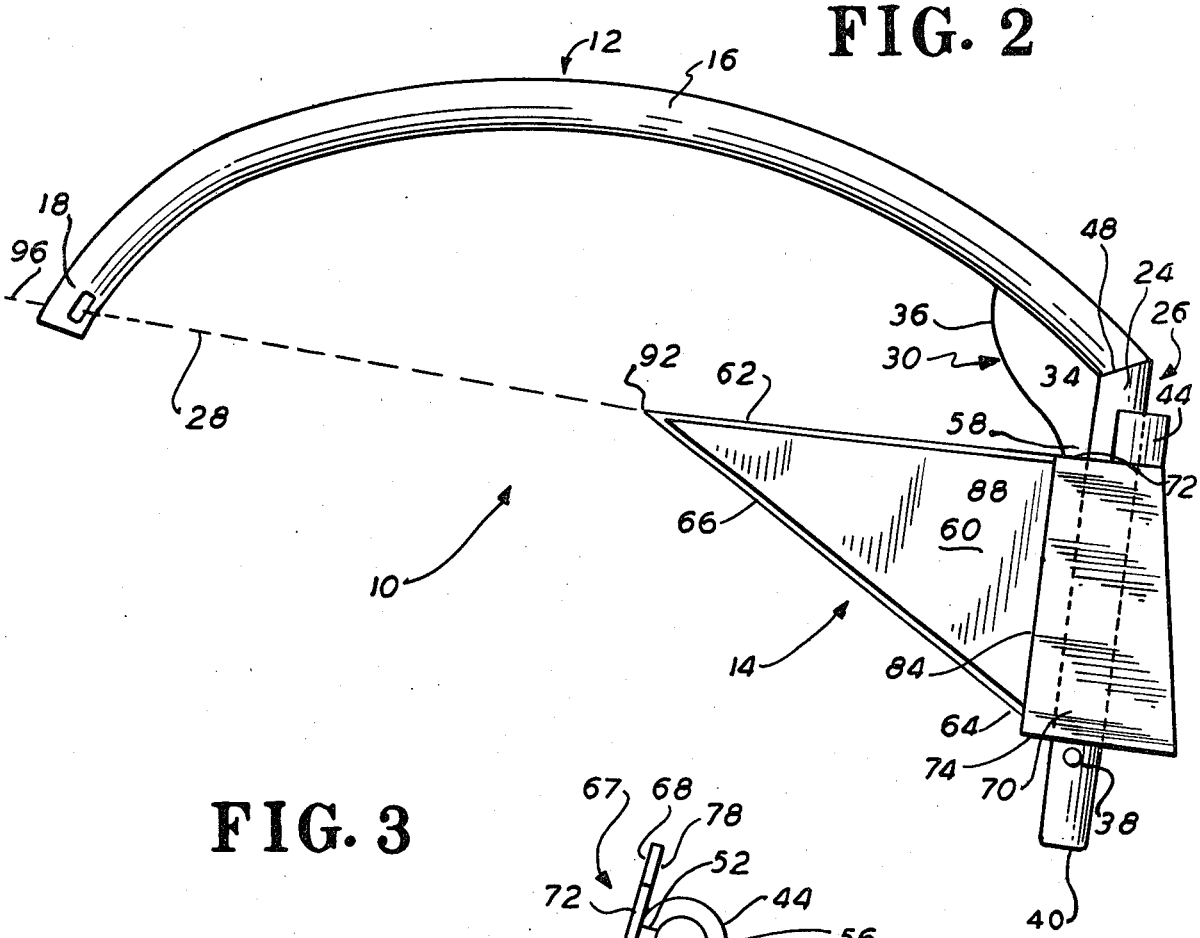
FIG. 2 is a plan side view of the anchor, constructed in accordance with the teachings of this invention.
Figure 4:
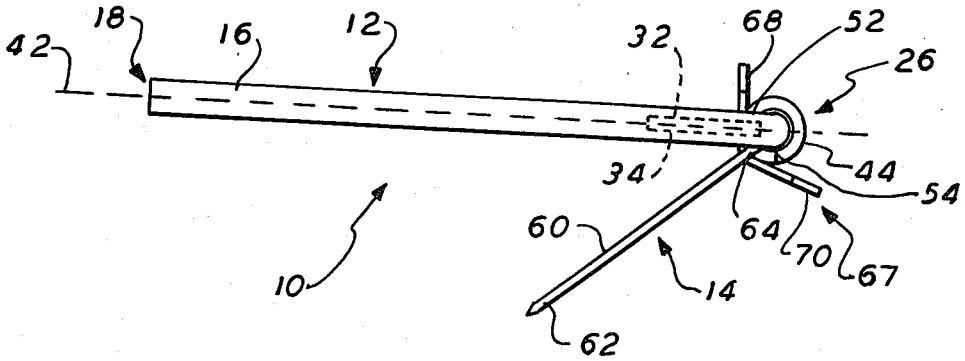
FIG. 4 is a top plan view of the anchor, constructed in accordance with the teachings of this invention.
Figure 5:
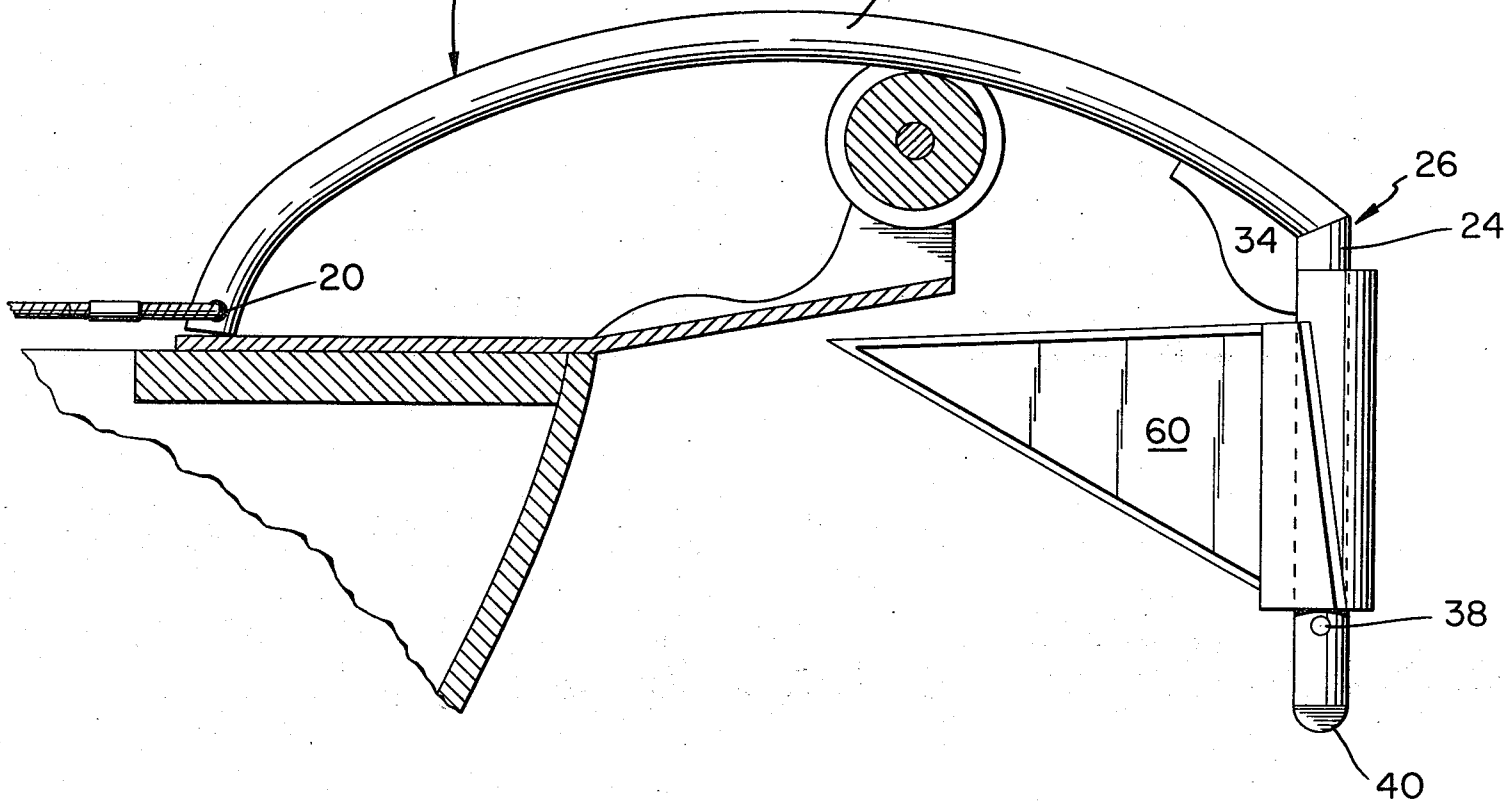
FIG. 5 shows a plan side view of the anchor with its major leg supported by a bow roller of an associated boat.

To overcome these disadvantages, there is provided an anchor 10 (FIGS. 1, 2 and 4). The anchor 10 of this invention generally comprises a shank 12 and a fluke 14. The shank 12 may be generally L-shaped and has a major leg 16 which may have a generally arcuate shape. Preferably, the major leg 16 is in the shape of an arc of a circle.

The forward or shackle end 18 of the major leg 17 has therein an aperture 20 for receiving a cable shackle 22 (FIG. 1). The shorter "L" leg 24 (FIGS. 1 and 2) extends perpendicular from the rear end 26 of the major leg 16 and extends in a direction generally radially inward from the arc formed by the major leg 16.

A web member 30 may be joined at the juncture 48 of the two legs 16 and 24 of the shank 12. The shank 12 may be formed of any well known rigid structural material commonly used in anchors, such as steel or the like. The web member 30 may be made of the same material and joined to the shank 12 by any commonly known manner, such as welding, casting, or the like.

The web member 30 may have opposed generally planar surfaces 32 and 34 and terminates in an arcuate edge 36 having a concavity in the same having the same general radius as the arcuate major leg 16. The web member 30 serves to strengthen the juncture of the legs 16 and 24 of the L-shaped shank 12.

The shorter leg 24 is intended to receive the fluke 14, as will be more fully discussed below. The leg has an aperture 38 (FIG. 2) in its free end 40, the purpose of which will be more fully discussed hereinafter.

It will be observed that the L-shaped shank 12 lies substantially in a plane (indicated in edge by the dashed line 42 in FIG. 4).

Figure 3:
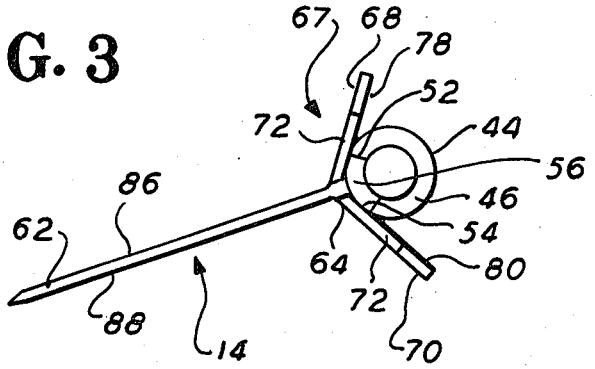
FIG. 3 is a top view of the fluke portion of the anchor, constructed in accordance with the teachings of this invention.

The fluke 14 may comprise a hollow, cylindrical member 44. The cylindrical member's interior diameter is so dimensioned as to receive therethrough the shorter "L" leg 24 of the shank 12. The end 46 of the cylinder 44 which is intended to be disposed adjacent to the juncture 48 of the legs 16 and 24 of the shank 12, has therein a notch 50. The notch 50 has an axially extending opening defined by opposed axially extending walls 52 and 54 (shown in edge view of FIG. 3). The axial walls 52 and 54 are segments of radii of the cylinder and are separated by an angle of preferably 86°. The notch 50 serves to locate the cylinder 44 on the L-leg 24 of the shank 12. Thus, the notch 50 terminates in a radially extending surface 56 within a particular angular range (FIG. 3). Thus, the rotational movement of the cylinder 44 is limited in its movement about the L-leg 24 of the shank 12 by the abutment of the axial walls 52 and 54 with the planar surface 32 and 34, respectively, of the web 30. The lower portion 58 (FIGS. 1 and 2) of the edge 36 of the web 30 abuts the notched radial wall 56 to axially locate the cylinder 44 on the leg 24 of the shank 12.

The fluke 14 further comprises a palm 60 which is, preferably, in the shape of a planar right angle triangle. One right angle side edge 62 of the triangular palm 60 is disposed to be co-terminus with an imaginary line 28 which may extend substantially perpendicular to the L-leg 24 and through the shackle end 18 of the arcuate leg 16 of the shank 12. A right angle base edge 64 of the palm 60 is secured to the cylindrical member 44 as by welding or the like. The palm 60 my extend outwardly, substantially radially from the cylinder 44. The top marginal edge 62 is substantially co-terminus with the bottom radial wall 56 of the notch 50. The base edge 64 is preferably at right angles to the top marginal edge 62. The lower marginal edge 66 completes the triangular shaped palm 60.

The palm 60 is secured to the cylindrical member 44 so as to extend radially therefrom, which radius bisects a chord drawn between the opposed axial walls 52 and 54 of the notch 50.

The fluke 14 may further comprise a crown 67. The crown 67 may be two trapezoidal, planar fins 68 and 70. Each fin 68 and 70 has opposed parallel upper and lower edges 72 and 74, respectively, which define the narrower dimensioned sides of the trapezoids. The edge 72 of each fin 68 and 70 may be co-terminus with the marginal edge 62 of the fluke and has a narrower length than the lower edge 74 which is, in turn, co-terminus with the lower radial end 76 of the cylindrical member 44. One of the planar sides 78 and 80 of each fin 68 and 70, respectively, is secured to the cylindrical member 44 as by welding or the like. One of the non-parallel edges 82 and 84 of each fin 68 or 70 is disposed to abut respective planar sides 86 or 88 of the palm 60 and may be joined or welded thereto. The fins 68 and 70, so disposed upon the member 44, may define an obtuse angle. Thus, the angle defined by the fins 68 and 70, with the member 44 being within the angle, may preferably be 115°. A pin 90 is inserted in the aperture 38 of the L-leg 24 to (axially) retain the fluke 14 on the shank 12.

In one embodiment, a typical 60-pound anchor constructed in accordance with this invention has a shank 12 of tubular configuration having an outer diameter of $1\frac{5}{8}$ inches. The major leg 16 has an interior radius of, for example, 24 inches and chord length measured at the outer edge thereof of 35 inches. The L-leg 24 has a length of 15 inches.

The cylindrical member 44 has an axial length of 10 inches, an external diameter of $2\frac{5}{8}$ inches, and an internal diameter of $1\frac{7}{8}$ inches. The palm 60 of the fluke 14 has a base edge 64 of 9 inches and a right angle side 62 of 16 inches. The remaining edge 66 of the palm 60 is 18 inches.

Each fin 68 and 70 parallel to side 72 may be approximately 3 inches in length. The longer side 74 may extend to approximately 5 inches.

Unlike the symmetrical anchors discussed above, the shank 12 of this invention is not intended to be disposed on top of the fluke 14. Rather, it is intended to engage the bed. It is immediately apparent that the end of the shank 26 having the fluke 14 secured thereto is heavier than the forward or shackle end 18. As a result, the arcuate contour of the major leg 16 causes the anchor 10 to tip rearward onto the fluke 14.

The quasi-symmetrical anchors all provide flukes which, when aligned in the symmetrical plane of the shank, provide a part of the major fluke or palm of either side of the plane. Here, it will be noted, the anchor 10 palm 60 is rotatable through the plane 42.

Still another significant difference lies in the manner of the pivoting of the fluke 14. Unlike the plow-type anchor, the fluke has no component of movement in the plane 42 of the shank 12. Thus, forces that may be exerted by the bed as the anchor 10 is pulled cannot force the fluke 14 either away or toward the major leg 16 in the plane 42 of the leg 16. In the plow, non-uniform forces exerted by the bed move the fluke away from a vertical position. (A vertical position, or a position in which the fluke is between the shank and the bed, is the preferred position.) The axis of rotation of the fluke is clearly such that as the fluke moves, the shank offers little resistance to such forces, such resistance forcing the plow from the bed.

In addition to its construction, the operation of the anchor 10 distinguishes it over previous anchors. It has the capacity to adjust its engagement so as to be capable of successfully engaging different soil types of beds. Referring to FIG. 2, it will be seen that a forward pull on the shackle end 18 causes one of the fins (68 in FIG. 1) to engage the bed. This engagement thereby causes the fluke 14 to pivot about the L-leg 24. This rotation is preferably limited to 46°. As the palm 60 rotates, the tip 92 engages the soil. The force at the forward or shackle end 18 is clearly delivered along line 28 of the point 92.

In hard beds, the tip 92 digs in and the bed does not readily yield to any component of movement that would cause the shank 12 to move in the plane 42. This resistance of the bed is believed to aid in concentrating the pulling force at the tip 92 to thereby cause penetration into the hard soil. Thus, the soil itself, due to its consistency, will aid in holding the anchor 10 in place.

In soft beds, the force delivered by the pulling at the shackle end 18 does not meet with as much resistance as with hard, compact soil. As a consequence, the anchor 10 may have a component of movement about the palm 60 and in the plane 42 in a counterclockwise direction in the case shown in FIG. 2. As the limit of the yield of the cable is reached, the anchor 10 will move or pivot in a counterclockwise direction. As the palm 60 buries itself deeper into the soil, the pivot point will shift from the tip 92 to a point on the palm 60. The result is an irregular oscillatory motion in the plane 42.

The fins 68 and 70, with the outward angulation of the trapezoidal shape, are believed to funnel lifted soil away from the anchor 10 in such a manner as to aid in maintaining a constant penetrating angle of the anchor 10 and inhibit a breaking loose or spiraling effect.

The back and forth movement in soft beds is a departure from the operation of prior anchors in which it was sought to dig in the fluke as one would with a hoe or shovel. The action of engagement of the bed by the anchor 10 enables it to accomodate the complex forces imparted by wind and water upon an anchorage. Clearly, there is rarely an idealized undirectional force in the line 28. Rather, in the practical use of an anchor, the resolution of forces provides components in various directions, unlike the prior art anchors, such a resolution of forces is believed to encourage the fluke 14 to pivotally dig more deeply into the bed.

It is further believed that the orientation of the shank 16 and the angle it forms with the bottom is less critical than in prior art anchors. For this reason, it has been observed that scope as short as 2:1 may be employed and the anchor 10 will, nevertheless, engage the bed. However, as the scope is increased, the engagement of the anchor 10 with the soil is improved so as to withstand greater pulling forces upon the shank 12.

Yet another benefit of the anchor 10 of this invention is its ease of stowing. This characteristic is very similar to the plow-type anchor. The rear end 26 is intended to conveniently engage the bow roller of a boat. It has been observed that a plow-type anchor has two major disadvantages. First, the connection of the articulated plow is bulky. This often requires the user to adjust the position of the anchor once it is drawn upon the bow roller. Further, the flaring plow fluke is often somewhat cumbersome. In the present anchor 10, the arcuate leg 16 of the shank 12 engages the bow roller and immediately rights the anchor 10 for stowing with the fluke over the bow of the boat and the shank 12 within the boat. The planar palm 60 is of limited thickness and, therefore, is less cumbersome to stow.

It is anticipated that various changes can be made to the preferred embodiment in order to provide a functionally similar anchor. For example, it is anticipated that the major leg 16, shown as an arc segment, may be replaced by two substantially straight members (not shown) welded together at the ends to form an obtuse angle. It is also possible to construct the major leg as a single, substantially straight member having an additional portion attached thereto (also not shown), the additional portion extending away from the fluke. Therefore, a wide variety of shapes may be provided for the legs, provided that an extended part of the anchor extends away from the fluke to cause the shank to pivot, about the extended part, with the fluke in at least one plane when an anchor line is pulling upon the forward end 18 of the anchor.

What is claimed:

1. An anchor of the type intended to be connected by a cable to a craft so as to be engaged in a bed and thereby to releasably moor a craft, said anchor comprising:

(a) a shank, the shank having a major leg and a shorter leg, the major leg having a forward and a rearward end, the legs being angularly joined at a juncture located at the rearward end of the major leg;

(b) the shank having a connection means, the shank being engaged by the cable at the forward end of the major leg by the connection means;

(c) a fluke pivotally secured for pivotal movement about an axis extending along said shorter leg, said fluke being pivotal with respect to said shank so as to be capable of moving said rearward end upward with respect to said bed, and at least a part of said fluke being engageable with the bed thereby causing force which is applied by the cable to the connection means to be transferred to the fluke;

(d) a part of the shank at said forward end curving away from the fluke so that it extends in a plane defined by the major and shorter legs, and extends away from the fluke, and said part being substantially prevented from pivoting about the shorter leg axis by said cable, causing said shank to pivot with said fluke in at least one plane about said part so as to substantially be capable, in response to the cable pulling upon the forward end, of moving in an oscillatory path in said one plane to thereby cause the fluke to more readily enter the bed.

2. An anchor as recited in claim 1 wherein said fluke is substantially alignable within said first mentioned plane, said fluke pivots with respect to said shank on either side of said first mentioned plane to an acute angle and said shorter leg axis is substantially within said first mentioned plane.

3. An anchor as recited in claim 2 wherein said fluke comprises a substantially planar palm being substantially alignable co-planar with said first mentioned plane.

4. An anchor as recited in claim 3 wherein said planar palm is pivotal to an acute angle on either side of said first mentioned plane.

5. An anchor as recited in claim 4 wherein said palm is a substantially triangular-shaped blade, said part engageable with the bed being at least the apex of said triangle.

6. An anchor as recited in claim 5 wherein said angularly joined legs form a generally L-shaped member and the shorter leg axis coincides with the shorter leg of said "L".

7. An anchor as recited in claim 6 wherein said fluke comprises a hollow cylindrical tube-like member, said palm extends radially from said cylindrical member, said cylinder is disposed for pivotal movement upon said shorter leg.

8. An anchor as defined in claim 7 wherein the major leg is comprised of a curvate portion, the convexity of the curved portion extending in said first mentioned plane away from the fluke, and said part of the shank curving away from the fluke is comprised of the curvate portion.

9. An anchor as recited in claim 8 wherein said fluke further comprises a crown; said crown comprises at least one fin disposed on one side of said palm and secured substantially tangentially to said cylindrical member.

10. An anchor as recited in claim 8 wherein said fluke further comprises a crown; said crown comprises at least two fins, each being substantially disposed on either side of said palm plane and each secured so as to be tangential to said cylindrical member; each of said fins being substantially planar trapezoidal members enclosing said cylindrical member within an obtuse angle and wherein the shorter parallel marginal edge of said fins is proximate to the major leg.

11. An anchor as recited in claim 10 wherein said palm is a substantially right angle triangle; said major leg defines an arc of a circle; one base marginal edge of said palm being secured to said cylindrical member; an edge side of said triangle extends toward an imaginary line through the shorter leg said anchor further comprises a web member secured at the juncture of said legs and within the included angle formed by said legs; said web comprises a planar member; said cylindrical member has a radially extending notch so as to receive therein said web member; said web member, in combination with said notch, thereby functions to limit said pivotal movement of said fluke to either side of said first mentioned plane; said palm being co-linear with a radius of said cylinder which bisects an imaginary chord across said notch; and a retaining means is provided in the shorter leg for retaining thereon said cylindrical member for said pivotal movement.

12. An anchor as recited in claims 1 or 10 wherein said oscillatory motion and said curved part permit the anchor to be engageable with the bed upon a scope substantially equal to or greater than 2:1.

13. An anchor comprising:

(a) an L-shaped shank lying substantially within a shank plane the shank having a major leg and a shorter leg, (b) a fluke pivotally secured to the shorter leg of said shank for pivotal rotation thereabout to at least an acute angle; said fluke comprising a substantially planar palm having a bed-engaging edge; said plane of said palm being substantially alignable within said shank plane;

(c) the major leg having a cable attachment means fixed to a forward end thereof, the forward end being that end of the major leg which is furthest from the shorter leg; and (d) the major leg further comprising a curved portion, the convexity of which extends within said plane away from the fluke, the curved portion being engageable with a bow roller so as to act as a stowing guide by rotationally aligning the anchor axially in the general direction that the cable and anchor are withdrawn past the bow roller.

14. An anchor as recited in claim 13 further comprising means for limiting said pivotal movement of said fluke to an acute angle on either side of said shank plane.

15. An anchor as recited in claim 14 wherein said acute angle is approximately 43° on either side of the plane.

16. An anchor as recited in claim 15 wherein said palm comprises a triangular blade and the curved portion forms an arc segment.

17. An anchor as recited in claim 16 wherein said limiting means comprises a web secured to said legs of said shank and engaging said fluke so as to act as a stop thereto.

18. The anchor of claim 13 wherein the convexity of the curved portion extends away from the fluke substantially beyond a line of force passing from the cable attachment through the fluke as a result of the cable pulling the anchor along a sea bed, thereby permitting the curved portion to rotate about an axis roughly defined by said line of force, causing the curved portion to engage the ground.

19. An anchor as recited in claim 18 wherein said rotation further permits the anchor to be engageable with the bed upon a scope substantially equal to or greater than 2:1.

20. An anchor of the type intended to be connected by a cable to a craft so as to be engaged in a bed and thereby to releasably moor a craft, said anchor comprising:

(a) a shank, the shank having a major leg and a shorter leg, the major leg having a forward and a rearward end, the legs being angularly joined at a juncture located at the rearward end of the major leg;

(b) the shank having a connection means, the shank being engaged by the cable at the forward end of the major leg by the connection means;

(c) a fluke pivotally secured for pivotal movement about an axis extending along said shorter leg, said fluke being pivotal with respect to said shank so as to be capable of moving said rearward end upward with respect to said bed, and at least a part of said fluke being engageable with the bed thereby causing force which is applied by the cable to the connection means to be transferred to the fluke;

(d) an extended part at said forward end of said major leg, said extended part extending in a plane defined by the major and shorter legs, and extending away from the fluke, and said extended part being substantially prevented from pivoting along the shorter leg axis by said cable, causing said shank to pivot with said fluke in at least one plane about said extended part so as to substantially be capable, in response to the cable pulling upon the forward end, of moving in an oscillatory path in said one plane to thereby cause the fluke to more readily enter the bed.

21. An anchor as recited in claim 20 wherein said shank is substantially alignable within said first mentioned plane, said fluke pivots with respect to said shank on either side of said first mentioned plane and said shorter legs axis is substantially within said first mentioned plane.

22. An anchor as recited in claim 21 wherein said fluke comprises a substantially planar palm being substantially alignable co-planar with said first mentioned plane.

23. An anchor as recited in claim 22 wherein said fluke is pivotal to an acute angle on either side of said first mentioned plane.

24. An anchor as recited in claim 23 wherein said palm is a substantially triangular-shaped blade, said part engageable with the bed being at least the apex of said triangle.

25. An anchor as recited in claim 24 wherein said angularly joined legs form a generally L-shaped member and the shorter leg axis coincides with the shorter leg of said "L".

26. An anchor as recited in claim 25 wherein said fluke comprises a hollow cylindrical tube-like member, said palm extends radially from said cylindrical member, said cylinder is disposed for pivotal movement upon said shorter leg.

27. An anchor as defined in claim 26 wherein the major leg is comprised of a curvate portion, the convexity of the curved portion extending in said first mentioned plane away from the fluke, and said extended part of the shank extending away from the fluke is comprised of the curvate portion.

28. An anchor as recited in claim 27 wherein said fluke further comprises a crown; said crown comprises at least one fin disposed on one side of said palm and secured substantially tangentially to said cylindrical member.

29. An anchor as recited in claim 27 wherein said fluke further comprises a crown; said crown comprises at least two fins, each being substantially disposed on either side of said palm plane and each secured so as to be tangential to said cylindrical member; each of said fins being substantially planar trapezoidal members enclosing said cylindrical member within an obtuse angle and wherein the shorter parallel marginal edge of said fins is proximate to the major leg.

30. An anchor as recited in claim 29 wherein said oscillatory motion and said curved part permit the anchor to be engageable with the bed upon a scope substantially equal to or greater than 2:1.

* * * * *